US005945016A

United States Patent [19]

Cormack

[11] Patent Number: 5,945,016

[45] Date of Patent: Aug. 31, 1999

[54] VAPOR DEGREASER

[75] Inventor: Roberg G. Cormack, Artesia, Calif.

[73] Assignee: D.I.S., Inc., dba Delta Industries, Santa Fe Springs, Calif.

[21] Appl. No.: 09/088,029

[22] Filed: Jun. 1, 1998

[51] Int. Cl.[6] ..... A21B 1/00

[52] U.S. Cl. ..... 219/393; 219/385; 219/399; 219/401; 134/108; 134/105; 202/170

[58] Field of Search ..... 219/393, 385, 219/391, 399, 401; 165/58, 61, 65; 134/10, 11, 12, 18, 105, 108, 109; 202/170

[56] References Cited

U.S. PATENT DOCUMENTS 4,246,116 1/1981 Cormack ..... 210/170
4,461,675 7/1984 Osterman et al. ..... 203/24
4,841,645 6/1989 Bettcher et al. ..... 34/78
4,893,223 1/1990 Arnold ..... 362/252
5,048,548 9/1991 Ramsey, Jr. ..... 134/108

*Primary Examiner*—Teresa Walberg
*Assistant Examiner*—Vinod D. Patel

[57] ABSTRACT

An improved vapor degreaser with a tank having a conventional lower portion with a solvent which is heated and cooling coils which largely combine the solvent vapor zone to a solvent vapor level. An upper tank portion rests above the conventional tank and has a second set of cooling coils. A first cover is placeable between the conventional tank and the upper tank portion. A second cover is placeable over the upper tank portion to provide a vapor degreaser with a much lower chance of any vapors escaping the degreaser.

9 Claims, 3 Drawing Sheets

VAPOR DEGREASER

BACKGROUND OF THE INVENTION

The field of the invention is vapor degreasers and the invention relates more particularly to vapor degreasers having a tank with a liquid solvent in the bottom which is heated to provide a solvent vapor zone used to remove soluble material from an object being degreased.

Conventional vapor degreasers are shown in U.S. Pat. No. 4,246,116 which was invented by the inventor of the present invention.

U.S. Pat. No. 5,048,548 shows a vapor degreaser with a three stage condenser/heat exchanger configuration for assisting in removal of solvent vapors so that they do not escape from the degreaser.

A door closure system for a vapor degreaser is shown in U.S. Pat. No. 5,261,736.

The solvents commonly used for vapor degreasing include methylene chloride, perchloroethylene, 1,1,1-trichloroethane, trichloroethylene, and trichlorotrifluoroethane. The vapors of some of these solvents are best eliminated as much as possible from the outside of the confines of a vapor degreaser. Although the solvents are heavier than air in the vapor state and tend to stay within the tank walls, breezes or drafts can cause the vapor to escape above the top of the tank walls. Past systems for preventing this have either been expensive or not sufficiently effective.

BRIEF SUMMARY OF THE INVENTION

It is an object of the present invention to provide an improved vapor degreaser which essentially eliminates the escape of solvent vapor during the degreasing process.

The present invention is for an improved vapor degreaser of the type having a degreaser tank with a bottom, a front wall, a back wall, a right side wall, and a left side wall. The degreaser has a liquid solvent in the bottom which is heated to provide a solid vapor zone above the liquid solvent. First means for cooling the solvent vapor zone are provided which creates a first freeboard area above the solvent vapor zone. The improvement of the present invention comprises an upper tank zone above the first freeboard area. The upper tank zone has a second means for cooling a second freeboard area above the first freeboard area and any solvent vapor which has escaped into the second freeboard area from the first freeboard area. A first cover is provided between the first freeboard area and the second freeboard area and a second cover is provided over the second freeboard area. The covers are preferably reciprocating covers comprised of two halves which meet in the middle and permit a chain to hold a part below the lower cover, said chain being positioned between each of the two cover halves. Preferably, the degreaser tank separates into an upper tank portion and the more conventional lower tank portion.

DESCRIPTION OF THE PREFERRED EMBODIMENTS

Figure 1:
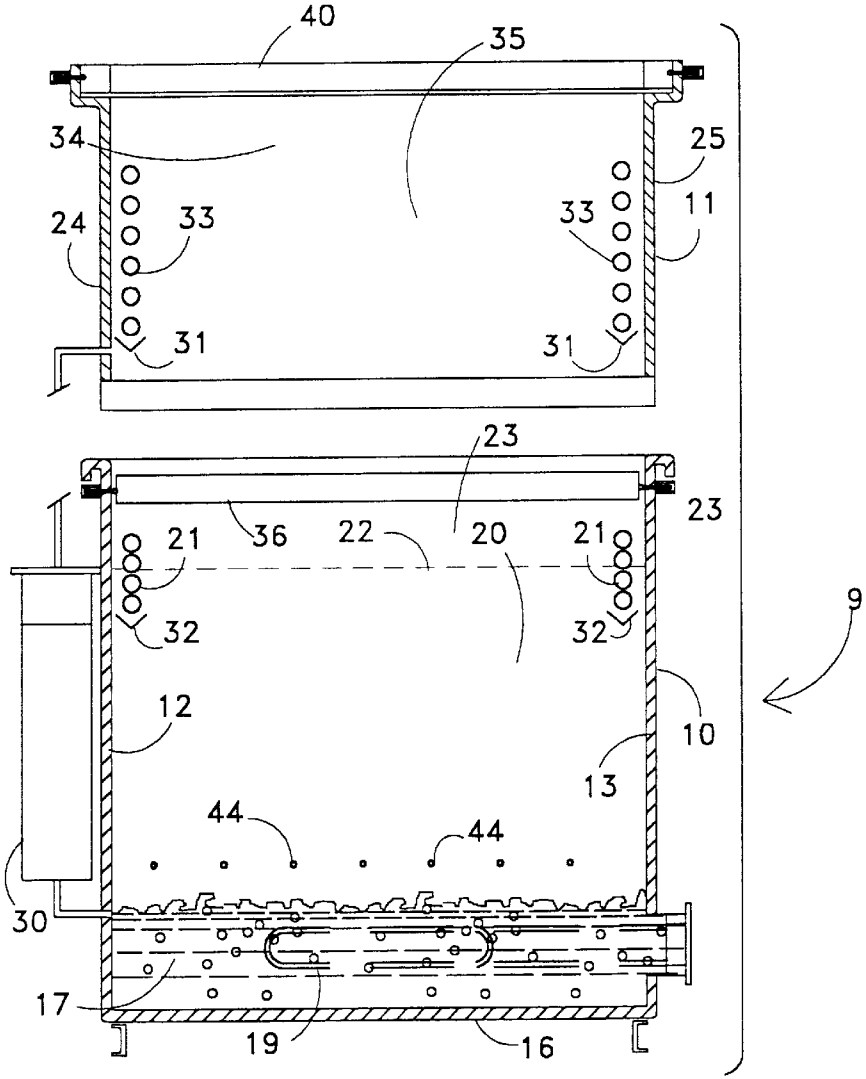
FIG. 1 is an exploded cross-sectional view showing the right and left sides and back wall of the improved vapor degreaser of the present invention.

The vapor degreaser of the present invention is shown in FIG. 1 in an exploded cross-sectional view where the degreaser has a lower tank portion 10 and an upper tank portion 11. Lower tank portion 10 has a left side wall 12, a right side wall 13, a back wall 14 and a front wall 15. A bottom 16 completes the lower tank portion 10. A liquid solvent 17 is held at a solvent depth 18 in the bottom of the tank. A heating coil 19 provides a source a heat to cause the liquid solvent to boil. The solvent vapor thus created provides a solvent vapor zone 20. Lower cooling coils 21 create a solvent vapor level 22 at the top of the solvent zone 20. If the surroundings of the tank were always quiescent, this system which is relatively conventional would be adequate. However, in reality, there are always some breezes and drafts and, thus, the solvent vapor level does not completely contain all of the solvent vapor and a small amount rises above the solvent vapor level 22 into a first freeboard area 23 in lower tank portion 10.

Upper tank portion 11 also has an upper left side wall 24, an upper right side wall 25, an upper back wall 26 and an upper front wall 27. The bottom flange 28 on upper tank portion 11 mates with a top flange 29 at the top of lower tank portion 10. A water separator 30 is conventional and the heavier solvent is returned to the liquid solvent 17. The water separator 30 is fed from trough 31 in the upper tank zone and trough 32 in the lower tank zone.

Upper tank portion 11 has second means for cooling comprising cooling coils 33. This second set of cooling coils provides a very low air temperature in the second freeboard area 34 and removes by condensation any vapor which may have escaped the first freeboard area 23. Coils 33 can be subzero coils to provide an exceptionally low temperature, and, thus, an exceptionally low vapor level. This upper tank zone 35 is thus maintained at a very low solvent vapor level.

Figure 2:
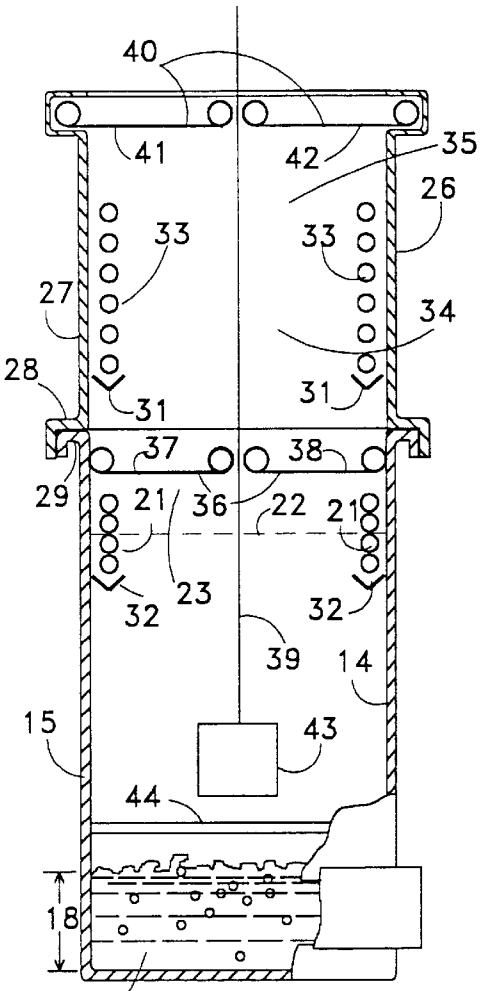
FIG. 2 is a cross-sectional view of the vapor degreaser of FIG. 1 with the upper tank portion connected to the lower tank portion and showing the front and back walls and the left side wall.

To further reduce the solvent vapor molecules in the second freeboard area 34, a first cover 36 tends to hold most escaped solvent molecules in first freeboard area 33. First cover 36 is a reciprocating type of cover which has a front half 37 and a back half 38. These two halves permit a chain 39 to pass between the two cover halves 37 and 38 so that the first freeboard area 23 is essentially covered with only a small gap between the two cover halves. First cover 36 is shown in the drawings mounted in lower tank portion 10. It is also possible to mount cover 36 in the bottom of upper tank portion 11. By doing this, the upper half 11 can be added as an after-market add-on to provide all the benefits of the degreaser of FIG. 2.

Furthermore, the upper tank zone 35 is covered with a second cover 30 consisting of front half 41 and back half 42. This similarly permits chain 39 through the second cover 40 with almost complete closure. The result is a vapor degreaser which has essentially no drafts within the first freeboard area 23 or the second freeboard area 34. The first cover 36 also permits the second freeboard area 34 to be held at a much lower temperature than the first freeboard area 23. This is the result of the second set of cooling coils 33 combined with the action of the two covers.

Another advantage of a covered upper tank zone 35 is the ability to maintain a very low temperature in the upper tank zone. For instance, the AQMD requires that the upper tank zone be 30% of the boiling point of the solvent. Thus, if the solvent boils at 250° F., the upper zone must be as low as 75° F. The construction of the degreaser of the present invention permits this upper tank zone to be as low as 40° F., thus, providing a much greater degree of safety as compared to the conventional 75° F.

Alternatively, the object being degreased 43 can be placed on horizontal rods 44 and equally degreased without any drafts disturbing the first and second freeboard areas. The second freeboard 34 is, thus, a chilled freeboard area. Another advantage of providing an upper half 11 separate from lower tank portion 10, is that it can be much easier to service. By providing clamps around flanges 28 and 29 it is possible to slide the upper tank portion as much as 75% off from lower tank portion 10. It is then possible to provide a great deal of service without draining the tank.

Figure 3:
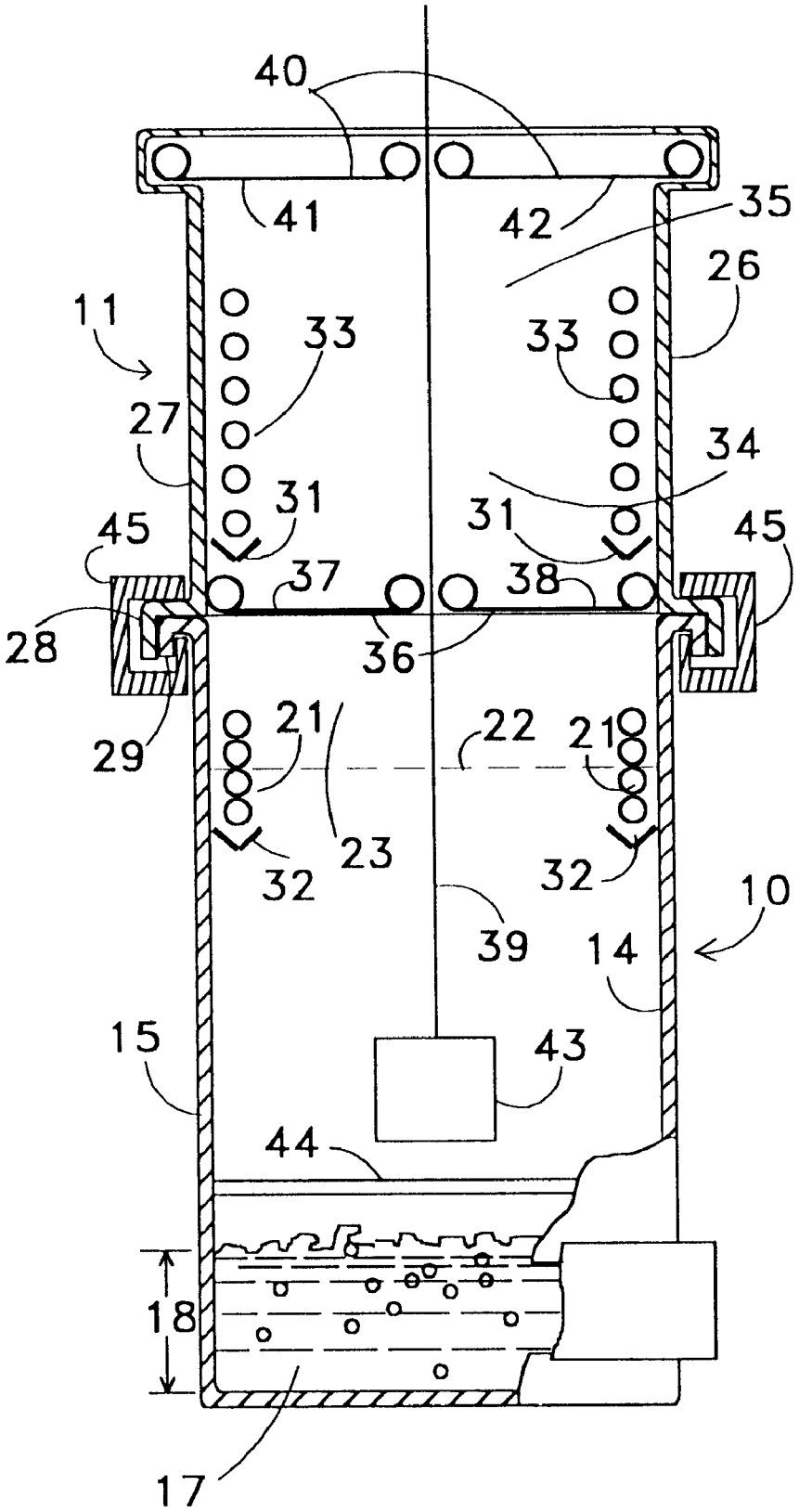
FIG. 3 is a cross-sectional view analogous to FIG. 2, except showing the cover mounted in the upper tank portion.
Figure 4:
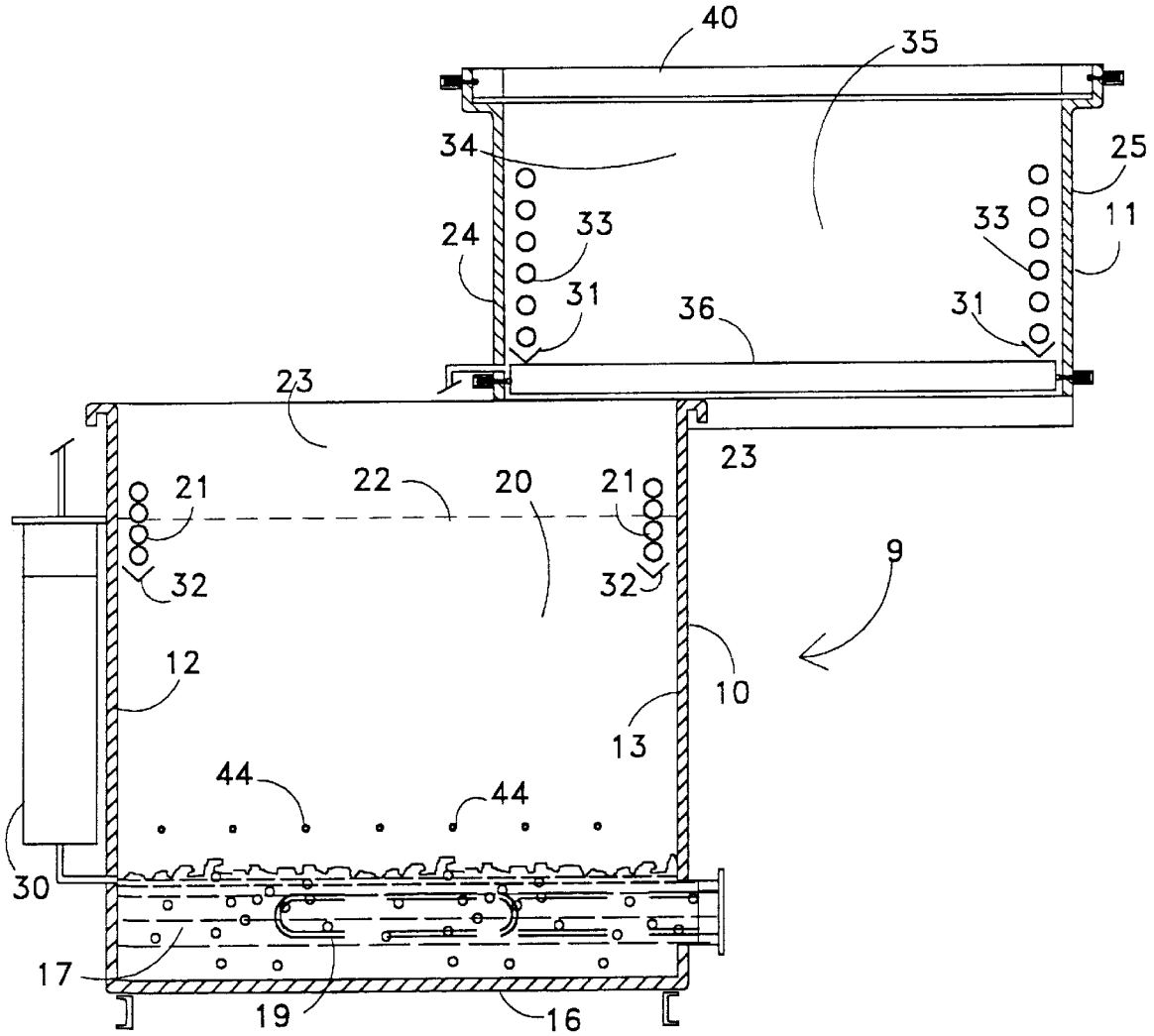
FIG. 4 is a cross-sectional view showing the upper tank portion slid to one side of the lower tank portion for servicing.

In FIG. 3 an alternative mounting of first cover 36 is shown where first cover 36 is mounted in upper tank portion 11. Also, a pair of clamps 45 are shown around flanges 28 and 29. These clamps 45 permit the upper tank portion to be slid so that it extends over lower tank portion 10 as shown in FIG. 4. In FIG. 4 where the upper tank portion 11 is slid to the right. It is to be understood that this upper tank portion can as easily be slid to the left. The clamps 45 are sufficient so that the upper tank 11 can be extended approximately 75% past lower tank 10. This permits the servicing of the upper tank portion without the necessity of draining the tank and airing it out for a prescribed amount of time.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An improved vapor degreaser of the type having a degreaser tank with a bottom, a front wall, a back wall, a right side wall and a left side wall, said degreaser having a liquid solvent extending a solvent depth above said bottom, means for heating the liquid solvent, a solvent vapor zone above the liquid solvent, first means for cooling the solvent vapor zone at solvent vapor level and a first freeboard area above the solvent vapor zone, wherein the improvement comprises:

an upper tank zone above said first freeboard area, said upper tank zone having second means for cooling a second freeboard area above the first freeboard area and any solvent vapor which has escaped into said second freeboard area from the first freeboard area;

a first cover between said first freeboard area and said second freeboard area between said first means for cooling the solvent vapor zone and the second means for cooling the second freeboard area above the solvent vapor zone; and a second cover on said tank above the second freeboard area.

2. The improved vapor degreaser of claim 1 wherein said degreaser tank is split into a lower tank portion having a bottom, a front wall, a back wall, a right side wall and a left side wall and an upper tank portion having an upper front wall, an upper back wall, an upper right side wall and an upper left side wall and said upper and lower tank portions are physically separable from one another.

3. The improved vapor degreaser of claim 1 wherein said first cover is a reciprocating cover comprised of two halves each of which travels half the tank width to allow the halves to close while a chain hoist suspends work in the solvent vapor zone.

4. The improved vapor degreaser of claim 3 wherein said second cover is also a reciprocating cover.

5. An improved vapor degreaser of the type having a degreaser tank having a lower tank portion with a bottom, a front wall, a back wall, a right side wall and a left side wall, said degreaser having a liquid solvent extending a solvent depth above said bottom, means for heating the liquid solvent, a solvent vapor zone above the liquid solvent, first means for cooling the solvent vapor zone at solvent vapor level and a first freeboard area above the solvent vapor zone, wherein the improvement comprises:

an upper tank portion separable from said lower tank portion but connected to said lower tank portion and said upper tank portion having an upper front wall, an upper back wall, an upper right side wall and an upper left side wall;

an upper tank zone largely in said upper tank portion and above said first freeboard area, said upper tank zone having second means for cooling a second freeboard area above the first freeboard area and any solvent vapor which has escaped into said second freeboard area from the first freeboard area;

a first cover between said first freeboard area and said second freeboard area between said first means for cooling the solvent vapor zone and the second means for cooling the second freeboard area above the solvent vapor zone; and a second cover on said tank above the second freeboard area.

6. The improved vapor degreaser of claim 5 wherein said first cover is a reciprocating cover comprised of two halves each of which travels half the tank width to allow the halves to close while a chain hoist suspends work in the solvent vapor zone.

7. The improved vapor degreaser of claim 6 wherein said second cover is also a reciprocating cover.

8. The improved vapor degreaser of claim 5 wherein said upper tank portion is slidably mounted on the top of said lower tank portion.

9. The improved vapor degreaser of claim 5 wherein said first cover is mounted in said upper tank portion.

* * * * *